US008403707B2

(12) United States Patent
Tai

(10) Patent No.: US 8,403,707 B2
(45) Date of Patent: Mar. 26, 2013

(54) POWER CONNECTOR WITH IMPROVED RETAINING MEMBER FOR BEING FLEXIBLY ASSEMBLED TO POWER CONTACT

(75) Inventor: Hung-Chi Tai, Jhonghe (TW)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 127 days.

(21) Appl. No.: 12/914,508

(22) Filed: Oct. 28, 2010

(65) Prior Publication Data

US 2011/0312225 A1 Dec. 22, 2011

(30) Foreign Application Priority Data

Jun. 22, 2010 (CN) ..... 2010 1 0205618
Jun. 22, 2010 (CN) ..... 2010 1 0205630

(51) Int. Cl.
*H01K 1/00* (2006.01)

(52) U.S. Cl. ..... 439/619; 439/397

(58) Field of Classification Search ..... 439/619, 439/397

See application file for complete search history.

(56) References Cited

U.S. PATENT DOCUMENTS 3,783,437 A * 1/1974 Graff et al. ..... 439/619
4,713,023 A * 12/1987 Bixler et al. ..... 439/393
5,122,081 A 6/1992 Bogiel et al.
5,158,471 A * 10/1992 Fedder et al. ..... 439/80
6,319,075 B1 * 11/2001 Clark et al. ..... 439/825
6,394,818 B1 * 5/2002 Smalley, Jr. ..... 439/79
6,402,566 B1 * 6/2002 Middlehurst et al. ..... 439/699.1
6,776,635 B2 * 8/2004 Blanchfield et al. ..... 439/181
7,458,839 B2 * 12/2008 Ngo et al. ..... 439/291
7,476,108 B2 * 1/2009 Swain et al. ..... 439/79
7,641,500 B2 * 1/2010 Stoner et al. ..... 439/357
7,641,523 B2 1/2010 Chen
7,666,025 B2 * 2/2010 Cheng et al. ..... 439/485
2005/0191894 A1 * 9/2005 Dinh ..... 439/397

* cited by examiner

*Primary Examiner* — Truc Nguyen

(74) *Attorney, Agent, or Firm* — Sughrue Mion, PLLC

(57) ABSTRACT

A power connector includes an insulative housing, a number of power contacts secured in the insulative housing and a retaining member. The insulative housing includes a receiving space recessed from a mating surface for accommodating a complementary connector, and a mounting space in communication with the receiving space. Each power contact includes a mounting portion residing in the mounting space and a contact portion protruding into the receiving space. The retaining member is combined to the mounting portion and then received in the mounting space. The retaining member is separable relative to the mounting portion in a non-destructive manner so that both the retaining member and the power contact are easily disassembled and replaced.

16 Claims, 7 Drawing Sheets

POWER CONNECTOR WITH IMPROVED RETAINING MEMBER FOR BEING FLEXIBLY ASSEMBLED TO POWER CONTACT

BACKGROUND OF THE INVENTION

1. Field of the Invention

The present invention relates to a power connector, and more particularly to a power connector with an improved retaining member for being flexibly assembled to power contacts.

2. Description of Related Art

U.S. Pat. No. 7,641,523 B2 issued on Jan. 5, 2010 discloses a traditional power connector including an insulative housing and a plurality of power contacts retained in passageways of the insulative housing for being mounted to a PCB. Each power contact includes a plurality of protrusion barbs, as shown in FIGS. 4 and 5, for abutting against inner surfaces of corresponding passageway for fixation. However, under this arrangement, the power contacts are directly and rigidly secured to the insulative housing. If the power contact has been wrongly fixed to the insulative housing or is broken in assembly and needed to be taken away, removal the power contact from the insulative housing unavoidably damages the passageway. As a result, even if a replacement power contact is newly inserted into the insulative housing, the replacement power contact might not be stably fixed in the passageway any more.

U.S. Pat. No. 5,122,081 issued on Jun. 16, 1992 discloses another type of power connector including an insulative housing, a plurality of contacts retained in the insulative housing and a plurality of cables fastened to the contacts. Each contact includes a pair of beams and an opening formed therebetween for receiving a conductive layer of corresponding cable. In assembly, the pair of beams are crimped by a stamping machine to be strongly connected with the cable. However, the stamping machine increases the assembly cost and is ineffective as well. Besides, once the beams are fixed with the cable, they can not be easily separated. As a result, reuse of the contacts and the cables is lowered.

Hence, a power connector with an improved retaining member for being flexibly assembled to power contacts is desired.

BRIEF SUMMARY OF THE INVENTION

The present invention provides a power connector comprising an insulative housing, a plurality of power contacts secured in the insulative housing, a plurality of cables connected to the power contacts, a retaining member fixed to the power contacts and then assembled to the insulative housing, and an organizer combining the corresponding cable and the power contact together. The insulative housing includes a receiving space recessed from a mating surface for accommodating a complementary connector, and a mounting space in communication with the receiving space. Each power contact includes a mounting portion residing in the mounting space, a contact portion protruding into the receiving space, and a connecting end extending from the mounting portion. The retaining member is combined to the mounting portion and then received in the mounting space. The retaining member is separable relative to the mounting portion in a non-destructive manner so that both the retaining member and the power contact are easily disassembled and replaced. The organizer comprises a first sleeve encasing the connecting end of the power contact in order to reliably connect the power contact and the cable.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
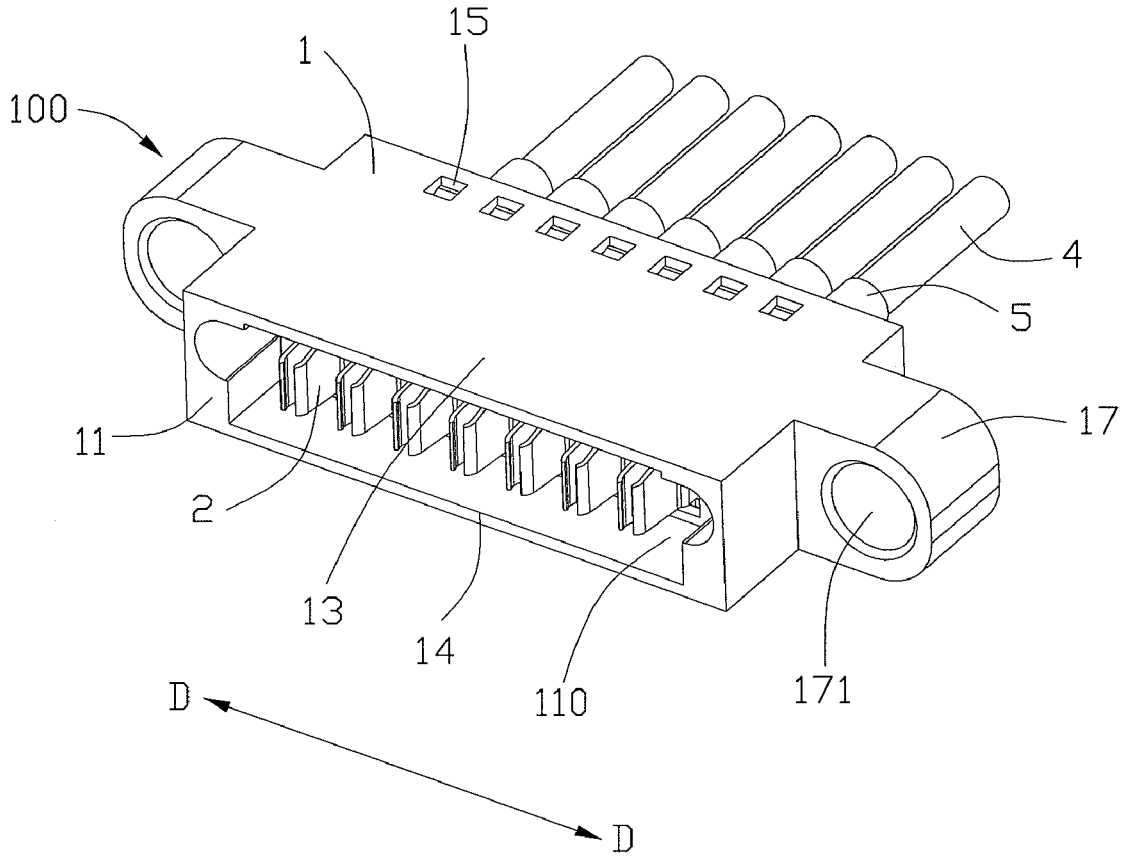
FIG. 1 is a perspective view of a power connector in accordance with an embodiment of the present invention.

Reference will now be made to the drawing figures to describe the embodiments of the present invention in detail. In the following description, the same drawing reference numerals are used for the same elements in different drawings.

Figure 2:
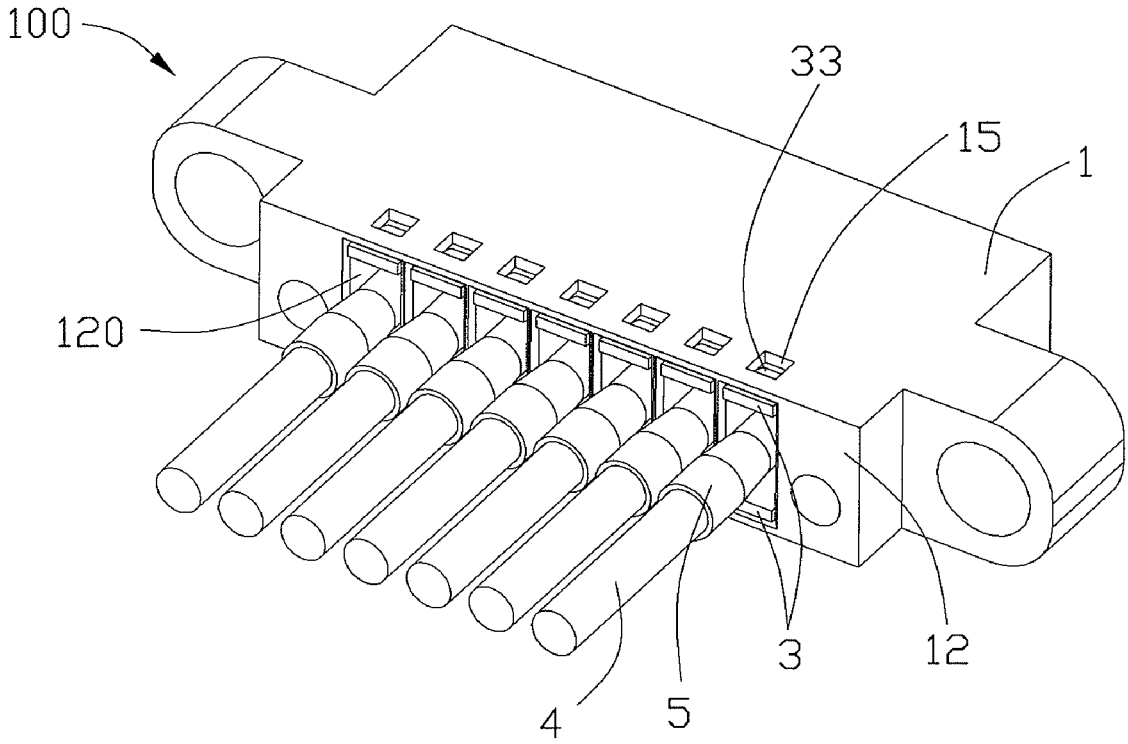
FIG. 2 is another perspective view of the power connector as shown in FIG. 1, taken from another aspect.
Figure 3:
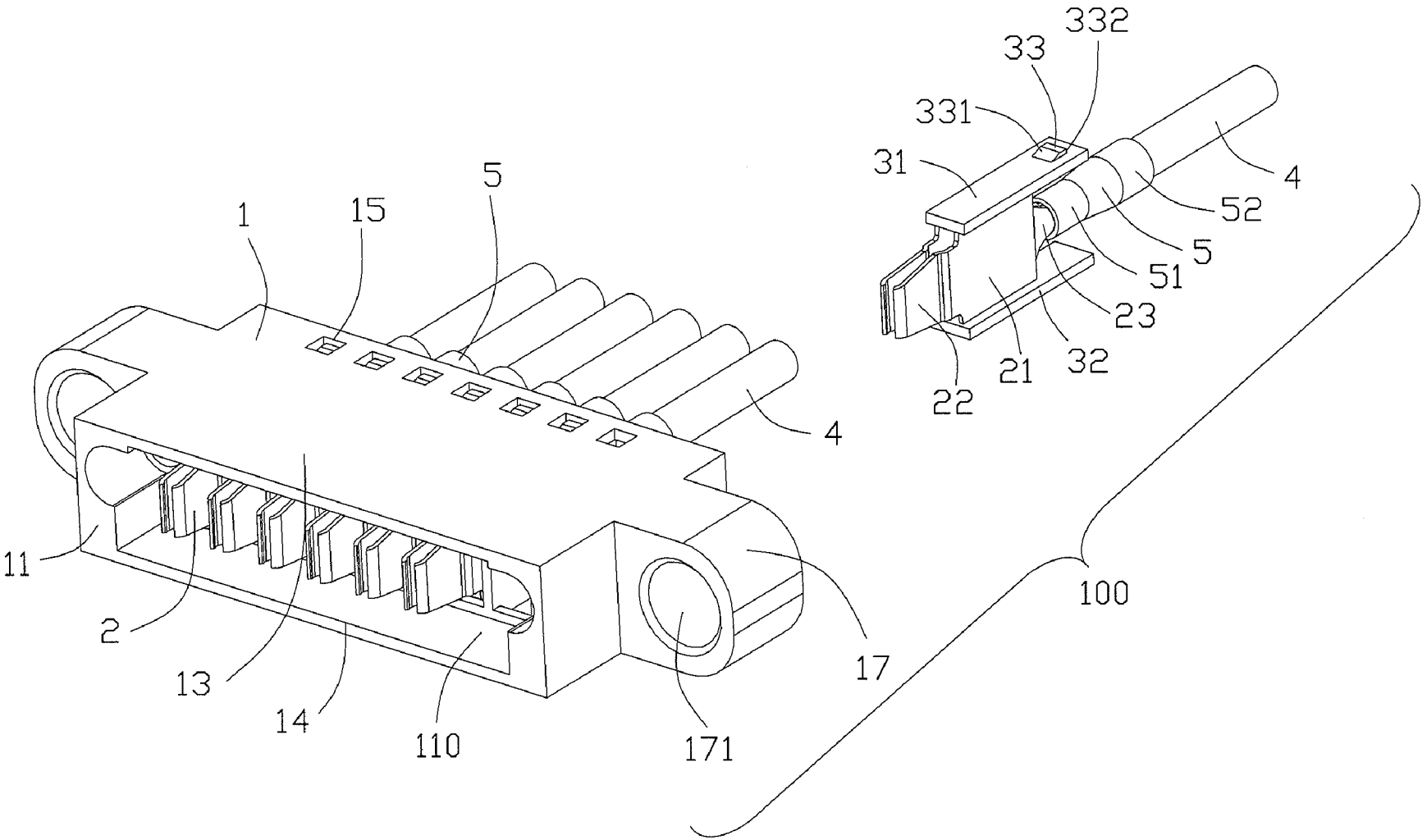
FIG. 3 is a partially exploded view of the power connector as shown in FIG. 1.

FIGS. 1 to 3 illustrate a power connector 100 including an insulative housing 1, a plurality of power contacts 2 retained in the insulative housing 1, a plurality of retaining members 3 fixed to the power contacts 2 and then assembled to the insulative housing 1, a plurality of cables 4 connected to the power contacts 2, and a plurality of organizers 5 for fixing the cables 4 to the power contacts 2.

Figure 7:
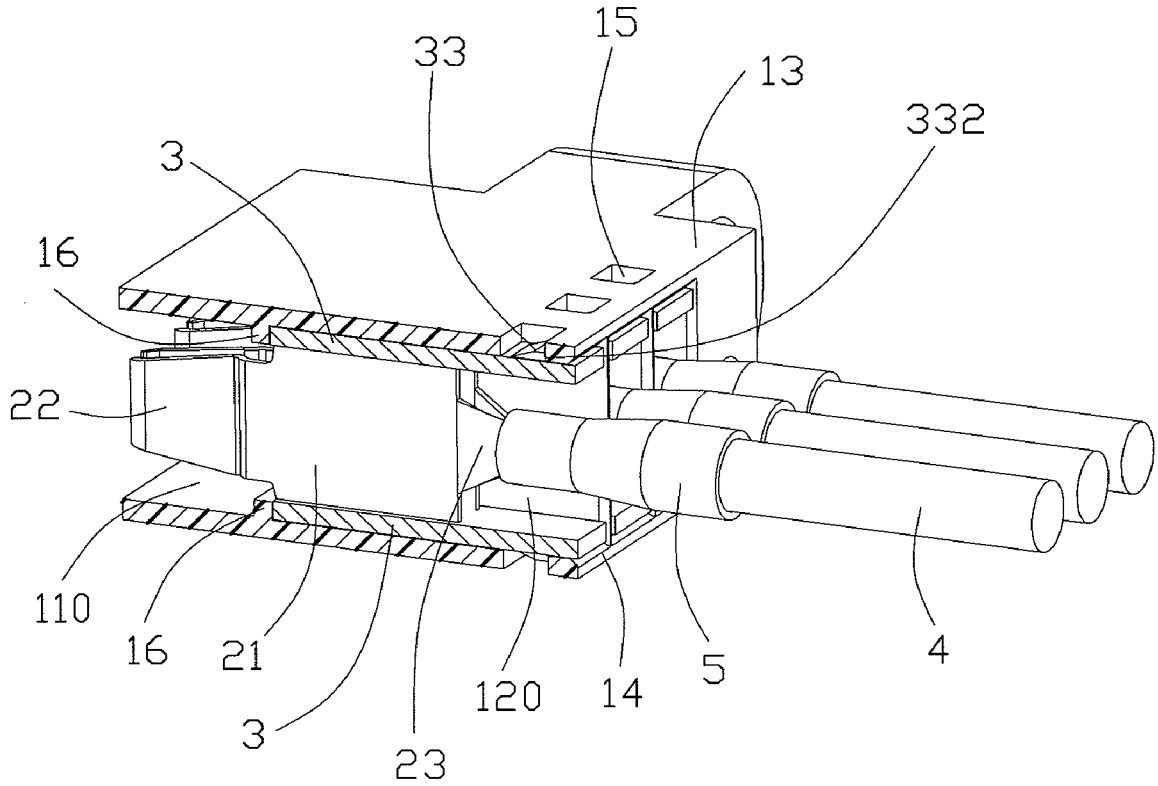
FIG. 7 is a partially perspective view of the power connector.

Referring to FIGS. 1, 2 and 7, the insulative housing 1 includes a mating surface 11, a rear surface 12 opposite to the mating surface 11, a receiving space 110 recessed from the mating surface 11 for accommodating a complementary connector (not shown), and a mounting space 120 recessed from the rear surface 12. The receiving space 110 is in communication with the mounting space 120 for jointly receiving the power contacts 2 and the retaining members 3. Besides, the insulative housing 1 includes a top wall 13 and a bottom wall 14 with the mounting space 120 formed between the top wall 13 and the bottom wall 14. The top wall 13 defines a plurality of top holes 15 upwardly extending therethrough and located adjacent to the rear surface 12. The top holes 15 are arranged side-by-side and do not extend backwardly through the rear surface 12. Similarly, the bottom wall 14 defines a plurality of bottom holes 15 downwardly extending therethrough and located adjacent to the rear surface 12. The bottom holes 15 are arranged side-by-side and do not extend backwardly through the rear surface 12 either. The top wall 13 and the bottom wall 14 includes a pair of positioning ribs 16 (as shown in FIG. 7) protruding into the mounting space 120 for forwardly restricting the retaining members 3 in assembly. The insulative housing 1 further includes a pair of symmetry flanges 17 on lateral sides thereof. Each flange 17 defines a mounting hole 171 for mating with guiding posts (not shown) of the complementary connector.

Figure 4:
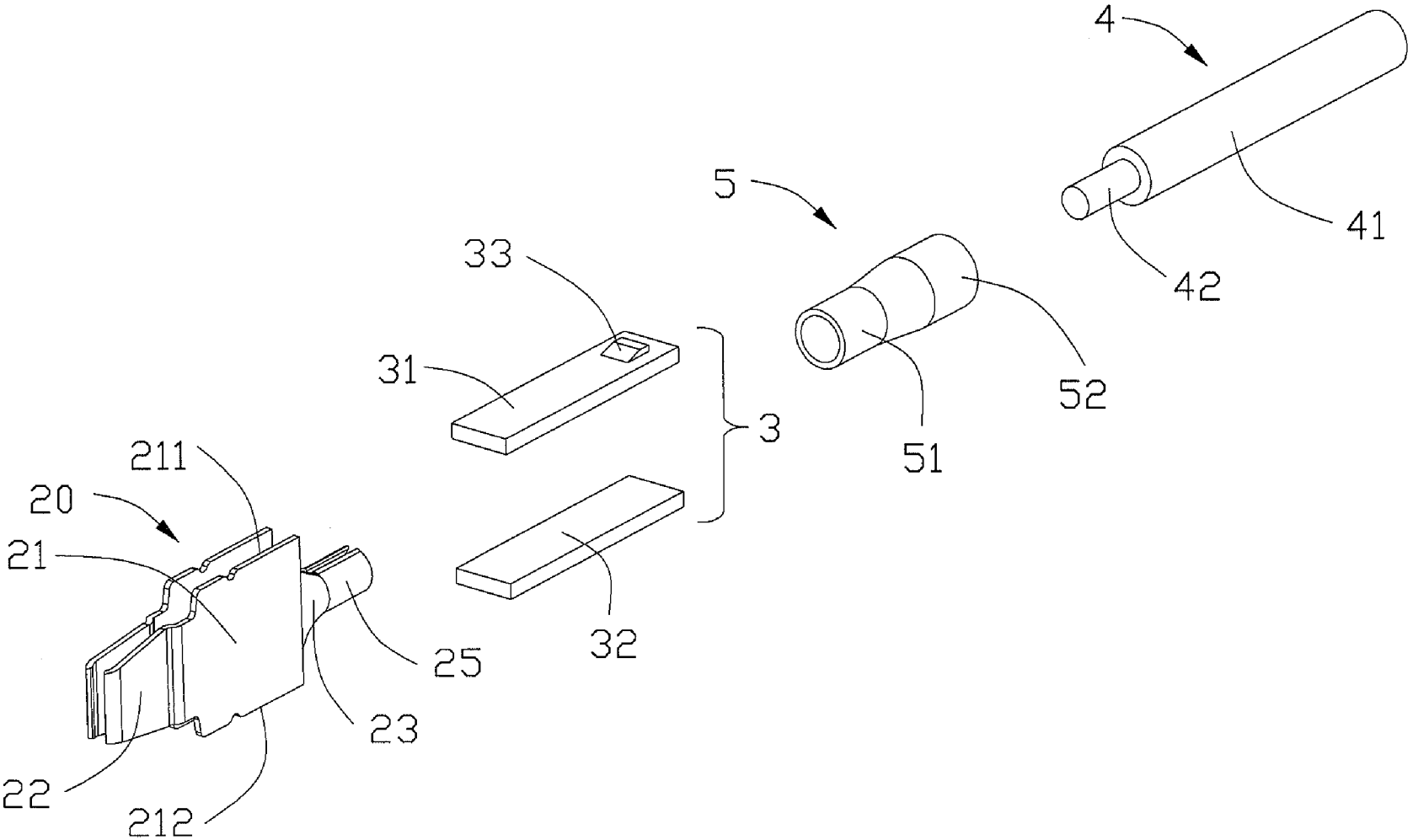
FIG. 4 is an exploded view of a contact pair separated from a retaining member, a cable and an organizer.
Figure 6:
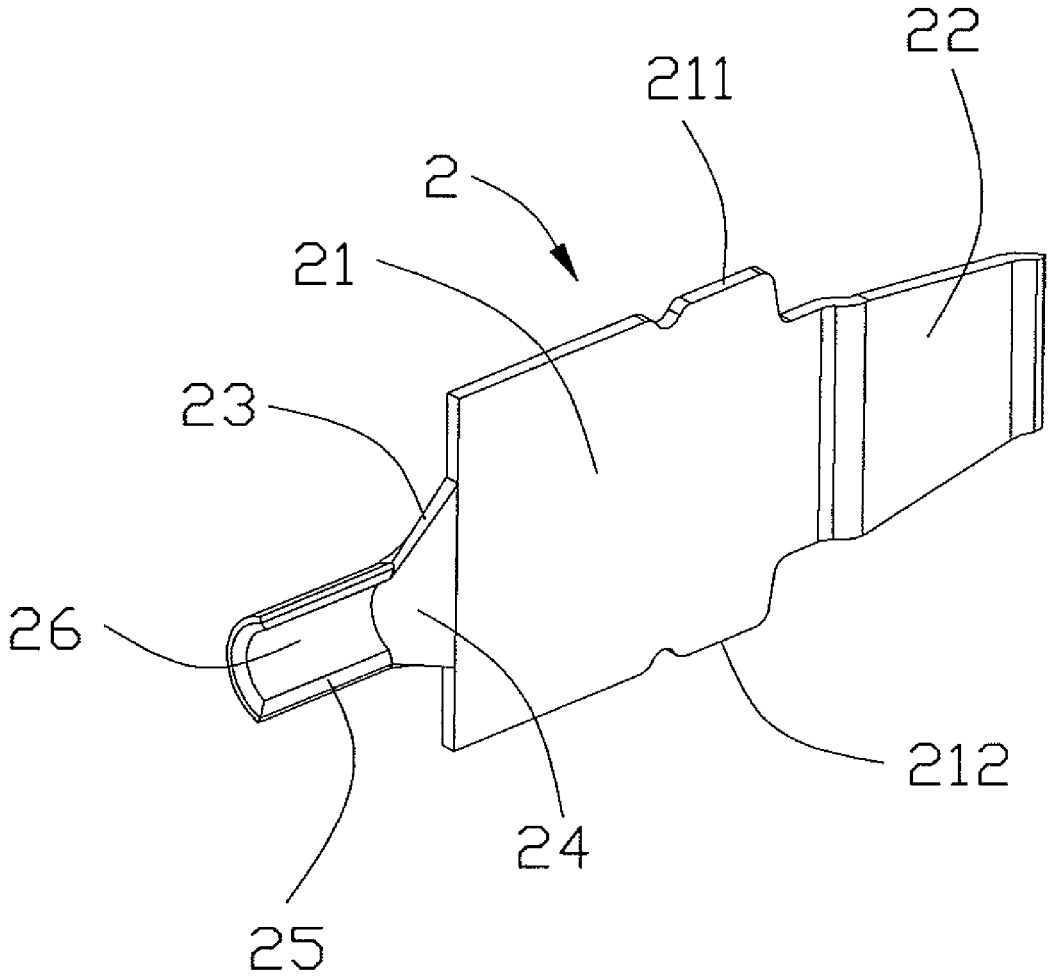
FIG. 6 is a perspective view of a power contact.

Referring to FIGS. 1, 4 and 6, the power contacts 2 are arranged side-by-side along a direction D-D perpendicular a front-to-rear direction. The power contacts 2 are of the same configurations for easily manufactured in mass production with effective costs. Each power contact 2 includes a flat mounting portion 21 residing in the mounting space 120, a contact portion 22 forwardly extending from one end of the mounting portion 21, and a connecting end 23 backwardly extending from the other end of the mounting portion 21. The contact portion 22 is contractive with respect to the mounting portion 21 and cantileveredly extends into the receiving space 110 for mating with the complementary connector. The mounting portion 21 includes a top side 211 and a bottom side 212. Referring to FIG. 6, the connecting end 23 includes a transition portion 24 and a tail 25 extending horizontally and backwardly from the transition portion 24. Each cable 4 includes a cylinder outer insulative coat 41 and a cylinder conductive layer 42 forwardly exposed to the outer insulative coat 41. The tail 25 includes an arced inner surface 26 configured to fit the conductive layer 42.

Figure 5:
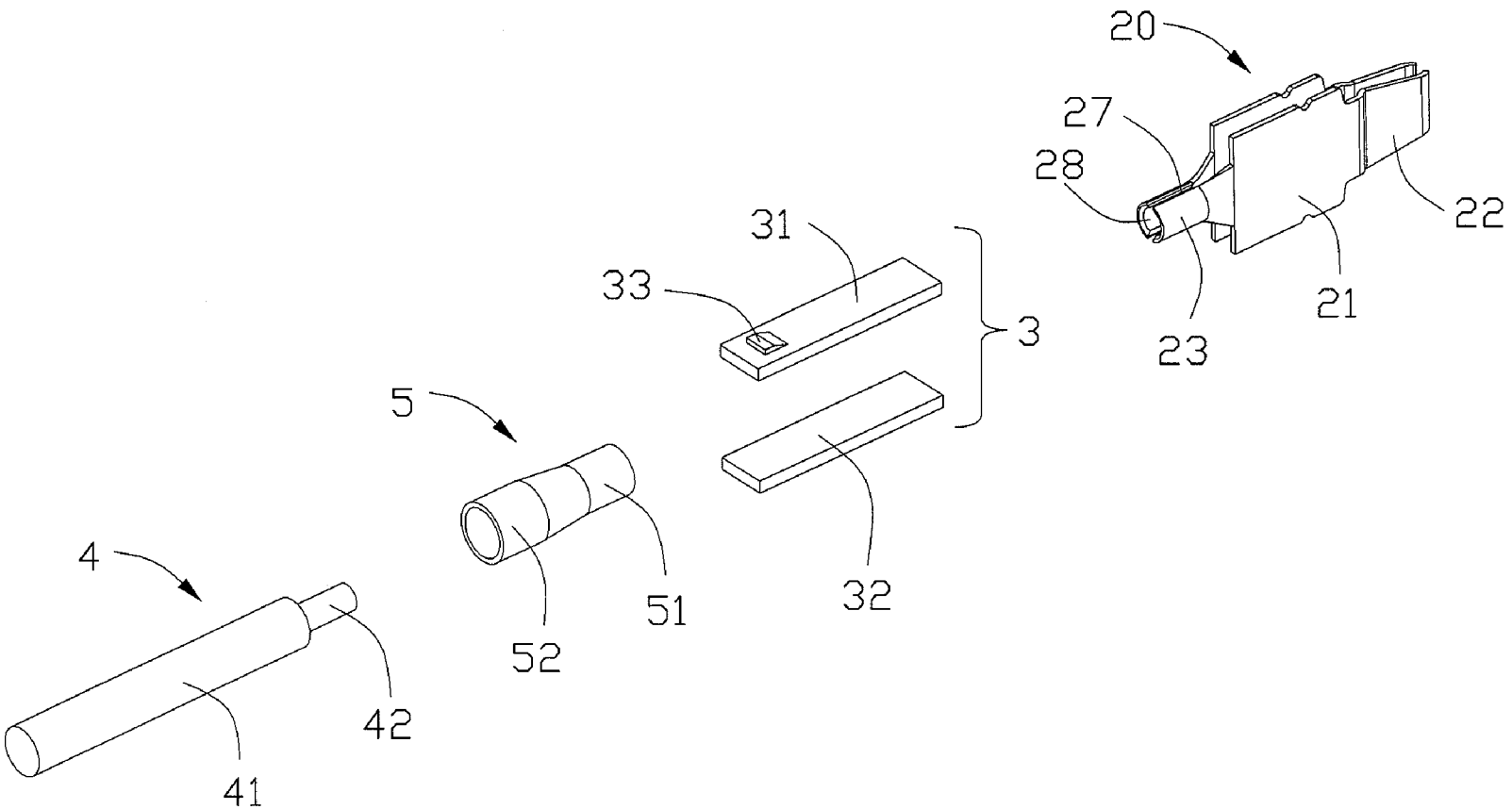
FIG. 5 is another exploded view as shown in FIG. 4, taken from another aspect.

As shown in FIGS. 3 to 5, a contact pair 20 is formed by adjacent and separate power contacts 2. Besides, according to the preferred embodiment of the present invention, all the power contacts 2 are of the same configurations, and in assembly, the contact pair 20 can be easily formed by selecting one power contact 2 and either power contact 2 which is overturned 180° with respect to the one power contact 2. Each mounting portion 21 is mainly located in a vertical plane.

As shown in FIGS. 3 to 5, the retaining member 3 includes a first block 31 fixed to the top sides 211 of the mounting portions 21 in the contact pair 20, and a second block 32 fixed to the bottom sides 212 of the mounting portions 21 in the contact pair 20. The first block 31 and the second block 32 are parallel to and separated from each other. The first block 31 and the second block 32 are flat and are mainly located in horizontal planes perpendicular to the vertical plane as shown in FIG. 3. The first block 31 and the second block 32 include top and bottom protrusions 33 fixed in the top and the bottom holes 15, respectively. The first block 31 and the second block 32 both extend backwardly beyond the mounting portions 21 and are located at an upper side and a lower side of the connecting ends 23, respectively. Each protrusion 33 includes an inclined guiding surface 331 and a vertical support surface 332. Since the top and the bottom holes 15 do not extend through the rear surface 12, the vertical support surface 332 of the protrusion 33 can abut against the insulative housing 1 for flexibly fixation. As a result, the contact pair 20 can be prevented from withdrawn from the insulative housing 1.

The retaining member 3 and the power contacts 2 are separately made and then fixed together. According to the preferred embodiment of the present invention, the mounting portions 21 in each contact pair 20 are partially fixed in corresponding slits (not shown) of the first block 31 and the second block 32 from both upper and lower sides. Because the retaining member 3 flexibly abuts against the insulative housing 1 via the lockable protrusions 33 and holes 15, the retaining member 3 can be easily disassembled from the insulative housing 1. Besides, the insulative housing 1 does not be broken in such disassembly process and can be used for assembling replacement retaining member 3 and the power contacts 2. The retaining member 3 is separable relative to the mounting portions 21 in a non-destructive manner. Under this condition, both the retaining member 3 and the power contact 2 are easily disassembled and replaced on occasion of error assembly of the power contact 2 or damage of the power contact 2. The retaining member 3 is made of an insulative material or a conductive material.

Referring to FIGS. 3 and 4, the organizer 5 includes a first sleeve 51 encasing the tail 25 and a second sleeve 52 encasing the outer insulative coat 41 for easily assembly. The second sleeve 52 is larger in diameter than the first sleeve 51. The organizers 5 function as another kind of retaining member for fixing the power contacts 2 with the cables 4.

In assembly, adjacent power contacts 2 are symmetrically arranged face to face in order to form the contact pair 20. The first block 31 and the second block 32 of the retaining member 2 are then fixed to the mounting portions 21 of the contact pair 20 from upper and lower sides. The tails 25 in the contact pair 20 are separated from each other by a pair of slits 27 in order to form a relative larger cylinderic cavity 28 (as shown in FIG. 5) for easily receiving the conductive layer 42 of the cable 4. The conductive layer 42 is jointly clipped by the tails 25 in the contact pair 20. When the first sleeve 51 encases the tails 25, the cavity 28 is accordingly compressed so that the arced inner surface 26 and the conductive layer 42 can be reliably connected. Then, the combination is inserted into the insulative housing 1 along a rear-to-front direction via the first and the second blocks 31, 32 guide the top and the bottom walls 13, 14. In such assembly process, mechanism tools used for forwardly pressing the power contacts 2 in traditional connector designs can be omitted. Such assembly process can be finished by hand with lower cost and high efficiency.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector, comprising:

an insulative housing comprising a receiving space recessed from a mating surface for accommodating a complementary connector, and a mounting space in communication with the receiving space;

a plurality of power contacts each comprising a mounting portion residing in the mounting space and a contact portion protruding into the receiving space; and a retaining member combined to the mounting portion and then received in the mounting space, the retaining member being lockable to the insulative housing; and wherein the retaining member is separable relative to the mounting portion in a non-destructive manner;

wherein the insulative housing comprises a top wall restricting the mounting space, and the retaining member comprises a first block fixed to a top side of the mounting portion, the top wall defining a top hole upwardly therethrough, and the first block comprising a top protrusion fixed in the top hole;

wherein the insulative housing comprises a bottom wall with the mounting space formed between the top wall and the bottom wall, the retaining member comprising a second block fixed to a bottom side of the mounting portion, the bottom wall defining a bottom hole downwardly therethrough, and the second block comprising a bottom protrusion fixed in the bottom hole wherein each power contact comprises a connecting end extending backwardly from the mounting portion for connecting a cable, the first block and the second block backwardly both extending beyond the mounting portion and being located at an upper side and a lower side of the connecting end, respectively.

2. The power connector as claimed in claim 1, wherein the first block and the second block are separated from and parallel to each other.

3. The power connector as claimed in claim 2, wherein the mounting portion is mainly located in a vertical plane, and the first block and the second block are flat and are mainly located in horizontal planes perpendicular to the vertical plane.

4. The power connector as claimed in claim 1, wherein the insulative housing comprises a pair of positioning ribs protruding into the mounting space to abut against the first and the second blocks, respectively, in order to forwardly restrict the first and the second blocks.

5. The power connector as claimed in claim 1, wherein the power contacts are side-by-side arranged in the insulative housing, and adjacent power contacts form a contact pair which is organized by the retaining member so that the contact pair can be inserted in to the insulative housing, simultaneously.

6. The power connector as claimed in claim 5, wherein the adjacent power contacts are of the same configuration while in different arrangement, the adjacent power contacts being symmetry with respect to a middle vertical plane disposed therebetween.

7. The power connector as claimed in claim 1, wherein the retaining member and the power contacts are separately made and then fixed with each other, the retaining member being made of an insulative material or a conductive material.

8. A power connector comprising:

an insulative housing comprising a receiving space recessed from a mating surface for accommodating a complementary connector, and a mounting space in communication with the receiving space;

a plurality of power contacts each comprising a mounting portion residing in the mounting space, a contact portion extending from one end of the mounting portion to protrude into the receiving space, and a connecting end extending from the other end of the mounting portion;

a plurality of cables each comprising a conductive layer, the connecting end comprising an arced inner surface configured to fit the conductive layer; and an organizer combining the corresponding cable and the power contact together, the organizer comprising a first sleeve encasing the connecting end of the power contact in order that the arced inner surface and the conductive layer are reliably connected;

wherein the power contacts are side-by-side arranged in the insulative housing, and adjacent power contacts form a contact pair, and wherein the connecting ends of the adjacent power contacts in the contact pair jointly clip the conductive layer of the cable.

9. The power connector as claimed in claim 8, wherein the connecting ends of the adjacent power contacts in the contact pair are separated from each other in order to form a relative larger cavity to easily receive the conductive layer.

10. The power connector as claimed in claim 9, wherein the connecting ends of the adjacent power contacts in the contact pair are symmetry with each other in order that the cavity is cylindric.

11. The power connector as claimed in claim 8, wherein the organizer comprises a second sleeve encasing an outer insulative coat of the cable to which the conductive layer is exposed, the second sleeve being larger in diameter than the first sleeve.

12. The power connector as claimed in claim 8, further comprising a retaining member fixed to the mounting portions of the adjacent power contacts in the contact pair, the retaining member being received in the mounting space and being lockable to the insulative housing.

13. The power connector as claimed in claim 12, wherein the retaining member is separable relative to the mounting portions of the adjacent power contacts in the contact pair in a non-destructive manner.

14. The power connector as claimed in claim 12, wherein the insulative housing comprises a top wall and a bottom wall with the mounting space formed therebetween, the retaining member comprising a first block fixed to a top side of the mounting portions and a second block fixed to a bottom side of the mounting portions, the first block and the second block being entirely inserted into the mounting space by guiding the top wall and the bottom wall, respectively.

15. The power connector as claimed in claim 14, wherein the top wall and the bottom wall respectively defines a top hole and a bottom hole, the first block and the second block being separated from and parallel to each other, the first block and the second block respectively comprising a top protrusion fixed in the top hole and a bottom protrusion fixed in the bottom hole.

16. The power connector as claimed in claim 14, wherein the mounting portions are mainly located in vertical planes, and the first block and the second block are flat and are mainly located in horizontal planes perpendicular to the vertical planes.

* * * * *